US011114794B2

(12) United States Patent
Takahashi et al.

(10) Patent No.: US 11,114,794 B2
(45) Date of Patent: Sep. 7, 2021

(54) CONNECTOR ON ELECTRIC VEHICLE FOR CHARGING THE ELECTRIC VEHICLE

(71) Applicant: Sumitomo Wiring Systems, Ltd., Mie (JP)

(72) Inventors: Kenya Takahashi, Mie (JP); Daisuke Ito, Mie (JP)

(73) Assignee: Sumitomo Wiring Systems, Ltd.

( * ) Notice: Subject to any disclaimer, the term of this patent is extended or adjusted under 35 U.S.C. 154(b) by 513 days.

(21) Appl. No.: 16/092,324

(22) PCT Filed: Mar. 20, 2017

(86) PCT No.: PCT/JP2017/011360
§ 371 (c)(1),
(2) Date: Oct. 9, 2018

(87) PCT Pub. No.: WO2017/179374
PCT Pub. Date: Oct. 19, 2017

(65) Prior Publication Data

US 2021/0218177 A1 Jul. 15, 2021

(30) Foreign Application Priority Data

Apr. 11, 2016 (JP) ..... JP2016-078837

(51) Int. Cl.
*H01R 13/436* (2006.01)
*H01R 13/506* (2006.01)
(Continued)

(52) U.S. Cl.
CPC ..... *H01R 13/4367* (2013.01); *H01R 13/506* (2013.01); *H01R 13/6275* (2013.01); *H01R 13/639* (2013.01); *H01R 2201/26* (2013.01)

(58) Field of Classification Search
CPC ..... H01R 13/4367; H01R 13/506; H01R 13/6275; H01R 13/639; H01R 2201/26; B60L 53/16
See application file for complete search history.

(56) References Cited

U.S. PATENT DOCUMENTS 9,543,713 B2 * 1/2017 Shimizu ..... H01R 13/70
9,601,864 B2 * 3/2017 Schmidt ..... H01R 13/5202
(Continued)

FOREIGN PATENT DOCUMENTS

JP 2002-343503 11/2002
JP 2010-123521 6/2010
(Continued)

OTHER PUBLICATIONS

International Search Report dated Jun. 20, 2017.

*Primary Examiner* — Oscar C Jimenez
(74) *Attorney, Agent, or Firm* — Gerald E. Hespos; Michael J. Porco; Matthew T. Hespos

(57) ABSTRACT

A connector (1) includes a first terminal with a first flange, a second terminal with a second flange, a housing (10) having first and second accommodating portions (14, 16), and a retainer. The first terminal is at a proper position in a front-rear direction in the housing (10) by being in the first accommodating portion (14) with the first flange locked by a first lock in the first accommodating portion (14). The second terminal is at a proper position in a front-rear direction in the housing (10) by being in the second accommodating portion (16) and having the second flange locked by a second lock in the second accommodating portion (16), but is rearward of the proper position in the front-rear direction when the second terminal is in the first accommodating portion (14) and the second flange is locked by the first lock.

4 Claims, 6 Drawing Sheets

(51) Int. Cl.
*H01R 13/639* (2006.01)
*H01R 13/627* (2006.01)

(56) References Cited

U.S. PATENT DOCUMENTS

| | | | | |
|---|---|---|---|---|
| 10,290,969 | B2 * | 5/2019 | Zhu | H01R 13/5213 |
| 10,320,115 | B2 * | 6/2019 | Xiao | H01R 13/5227 |
| 2002/0173205 | A1 | 11/2002 | Kato | |
| 2011/0034053 | A1 | 2/2011 | Matsumoto et al. | |
| 2011/0287667 | A1 * | 11/2011 | Ichio | H01R 13/4367<br>439/660 |
| 2016/0072224 | A1 | 3/2016 | Ichio | |

FOREIGN PATENT DOCUMENTS

| | | |
|---|---|---|
| JP | 2011-249039 | 12/2011 |
| WO | 2012/146766 | 11/2012 |
| WO | 2014/147760 | 9/2014 |

* cited by examiner

CONNECTOR ON ELECTRIC VEHICLE FOR CHARGING THE ELECTRIC VEHICLE

BACKGROUND

Field of the Invention

This specification relates to a connector.

Related Art

Japanese Unexamined Patent Publication No. 2010-123521 discloses a vehicle-side connector to be fit and connected to a feeding-side connector in an electric vehicle to charge a battery mounted in the vehicle. The vehicle-side connector of this type has a housing with a terminal accommodating portion that accommodates a male ground terminal (also referred to as an earth terminal) and a male power terminal (also referred to as a charging terminal).

The ground terminal and the power terminal in the vehicle-side connector of Japanese Unexamined Patent Publication No. 2010-123521 are configured similarly. Thus, it has been difficult to detect from outside the connector whether the ground terminal and the power terminal are accommodated in wrong terminal accommodating portions.

The invention disclosed in this specification was created in view of the above problem and aims to suppress the erroneous mounting of terminals.

SUMMARY

The invention is directed to a connector with a first terminal including a shaft-like first terminal portion and a first flange protruding from the first terminal portion, a second terminal including a shaft-like second terminal portion and a second flange protruding from the second terminal portion. The connector also has a forwardly open housing with first and second accommodating portions. The first terminal is accommodated in the first terminal accommodating portion from behind and is retained so as not to come out forward. Similarly, the second terminal is accommodated in the second terminal accommodating portion from behind and is retained so as not to come out forward. A retainer is assembled with the housing from behind the housing. The first terminal is positioned at a proper position in a front-rear direction with respect to the housing by being accommodated into the first accommodating portion along an axial direction of the first terminal portion and having the first flange locked by a first locking portion provided on an inner wall of the first accommodating portion. Similarly, the second terminal is positioned at a proper position in the front-rear direction with respect to the housing by being accommodated into the second accommodating portion along an axial direction of the second terminal portion and having the second flange locked by a second locking portion provided on an inner wall of the second accommodating portion. On the other hand, the second terminal is positioned on a side rearward of the proper position in the front-rear direction if the second terminal is accommodated into the first accommodating portion and the second flange is locked by the first locking portion.

In the above-described connector, the first terminal can be accommodated properly in the first accommodating portion by having the first flange locked by the first locking portion of the first accommodating portion, and the second terminal can be accommodated properly in the second accommodating portion by having the second flange locked by the second locking portion of the second accommodating portion. On the other hand, if the second terminal erroneously is accommodated into the first accommodating portion, the second terminal is positioned on the side rearward of the proper position. An attempt then may be made to assemble the retainer with the housing from behind the housing. However, the retainer will interfere with the second flange of the second terminal and is shifted rearward of the proper position. Thus, it can be discriminated from the outside of the connector that the second terminal has been accommodated erroneously into the first accommodating portion, and the erroneous mounting of the terminals can be prevented.

The first flange may be stepped in the front-rear direction by being composed of plural disc-shaped parts whose outer diameters become larger toward a rear end in a stepwise manner. The first locking portion may be shaped such that a part of the inner wall of the accommodating portion protrudes inward while ensuring a through hole penetrating in the front-rear direction so that a protruding part is stepped in the front-rear direction to make an opening diameter of the through hole larger toward the rear in a stepwise manner. Thus, the through hole may have plural contact surfaces to be held in contact with the first flange in the front-rear direction when the first terminal is accommodated in the first accommodating portion. The second flange may be a single disc having a thickness in the front-rear direction larger than a thickness in the front-rear direction of the disc-shaped part located on a rearmost end of the first flange, and to be in contact with only the contact surface located on a rearmost side of the first locking portion in the front-rear direction when the second terminal is accommodated in the first accommodating portion.

In this configuration, the thickness of the second flange is made larger than the thickness of the disc-shaped part located on the rearmost side of the first flange. Thus, if the second terminal is locked by the first locking portion and the second flange of the second terminal only contacts the contact surface located on the rearmost side of the first locking portion. Accordingly, the position of a rear end part of the second flange is shifted rearward of the proper position, i.e. a position where the first flange is locked by the first locking portion, so that the second terminal is shifted rearward of the proper position. In this way, a specific configuration is provided for positioning the second terminal rearward of the proper position in the front-rear direction if the second terminal is accommodated erroneously in the first accommodating portion.

The first terminal may be positioned rearward of the proper position in the front-rear direction when the first terminal is accommodated into the second accommodating portion and the first flange is locked by the second locking portion. In this configuration, if the first terminal is accommodated erroneously into the second accommodating portion, the first terminal is rearward of the proper position. Thus, if it is attempted to assemble the retainer with the housing from behind the housing thereafter, the retainer interferes with the first flange of the first terminal and is shifted rearward of the proper position. Thus, the errouneous accommodation of the first terminal into the second accommodating portion can be determined from outside the connector, and the erroneous mounting of the terminals can be avoided.

The second flange may be in the form of a single disc. Additionally, the second locking portion may have one contact surface to be held in contact with the second flange in the front-rear direction with the second terminal accommodated in the second accommodating portion by a part of the inner wall of the second accommodating portion protruding inward while ensuring a through hole penetrating in the front-rear direction. The first flange may be stepped in the front-rear direction by being composed of plural disc-shaped parts whose outer diameters become larger toward the rear in a stepwise manner. A thickness of the disc-shaped parts in the front-rear direction may be larger than a thickness of the second flange in the front-rear direction, and only the disc-shaped part located on a foremost sides of the first flange portion be in contact with the contact surface of the second locking portion when the first terminal is accommodated in the second accommodating portion.

In this configuration, the thickness of the entire first flange is larger than the thickness of the second flange. Thus, if the first terminal is locked by the second locking portion and the disc-shaped part located on the foremost side of the first flange of the first terminal contacts the contact surface of the second locking portion, the position of a rear end of the first flange is shifted rearward of the proper position, i.e. a position where the second flange is locked by the second locking portion, and the first terminal is shifted rearward of the proper position. In this way, the first terminal is rearward of the proper position in the front-rear direction if the first terminal is accommodated erroneously into the second accommodating portion.

The retainer may be fit to the housing by being moved forward from behind the housing to a position where a front end of the retainer contacts each of a rear end part of the first terminal and a rear end part of the second terminal when the first and second terminals are positioned at the proper positions. According to this configuration, if at least one of the first and second terminals is mounted erroneously and the erroneously mounted terminal is shifted rearward of the proper position, the retainer cannot be moved forward to the proper position (position where the first and second terminals are positioned at the proper positions). As a result, the retainer cannot be fit to the housing and the erroneous mounting of the first and second terminals can be discriminated easily from the outside the connector.

The first terminal may include a shaft-like first connecting portion disposed behind the first flange, and the second terminal may include a shaft-like second connecting portion disposed behind the second flange. The retainer may include a surrounding wall for circumferentially surrounding at least one of the first connecting portion of the first terminal and the second connecting portion of the second terminal when the retainer is fit to the housing, and a projection may be provided on an inner wall of the surrounding wall and may project in. A projecting tip may be located proximate to at least one of the first connecting portion and the second connecting portion and may be provided on an inner wall of the surrounding wall. Note that a "proximate" state of the projecting tip of the projection mentioned in this specification also includes a contact state of the projecting tip of the projection with the first and second connecting portions. According to this configuration, if the front end of one of the first and second terminals accommodated in the first and second accommodating portions is displaced down, the connecting portion of the one terminal interferes with the projection. Thus, the inclination of the respective terminals can be suppressed when the first and second terminals are accommodated respectively in the first and second accommodating portions, and dimensional accuracy in the mounted state of the first and second terminals accommodated in the first and second accommodating portions can be enhanced.

According to the invention disclosed in this specification, it is possible to suppress the erroneous mounting of terminals.

DETAILED DESCRIPTION

Figure 1:
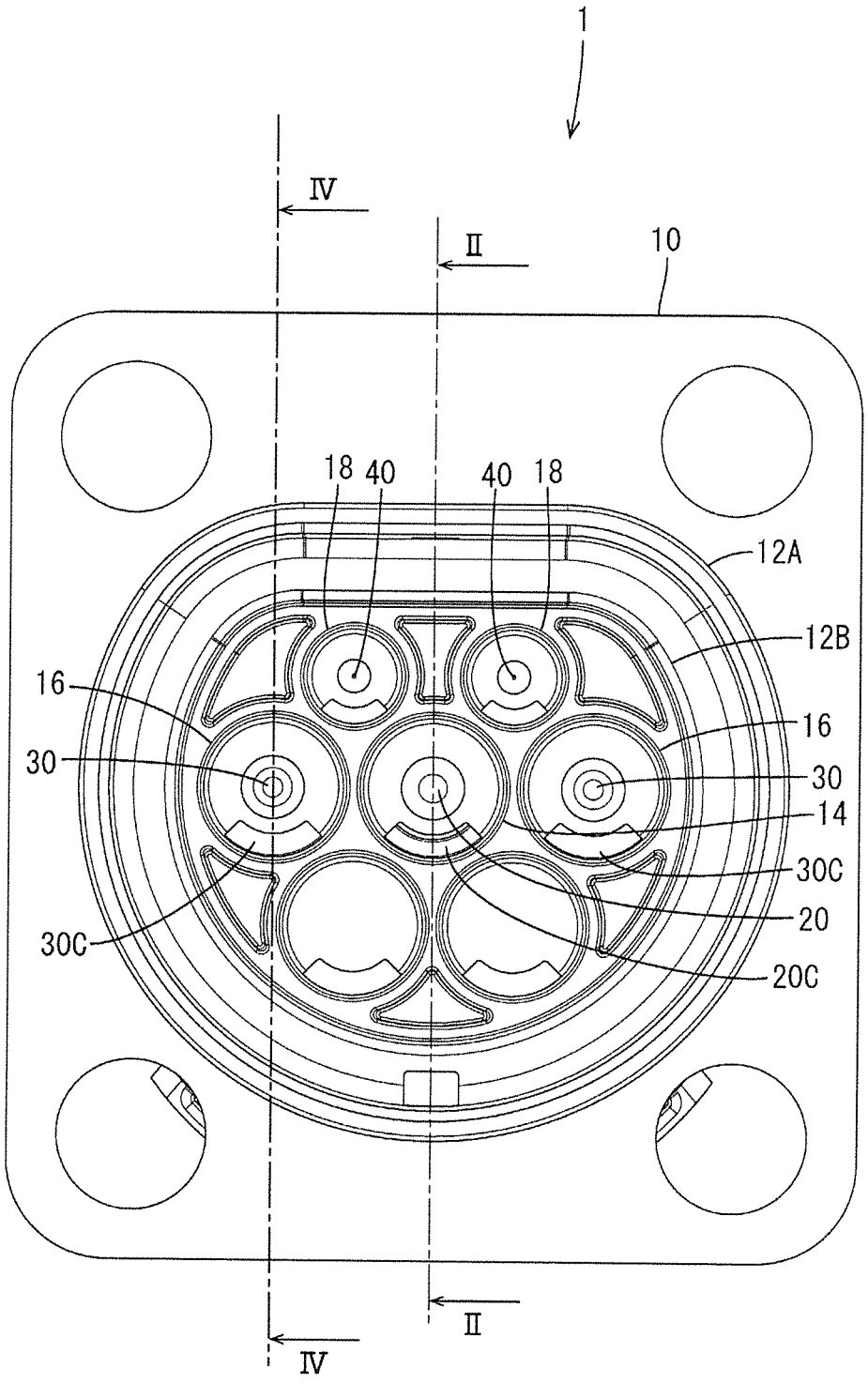
FIG. 1 is a front view of a connector according to an embodiment.

An embodiment is described with reference to the drawings. This embodiment illustrates a connector 1 in an electric vehicle and to be fit and connected to a feeding-side connector to charge a secondary battery in the vehicle. As shown in FIG. 1, this connector 1 includes a housing 10 made of synthetic resin and constituting the outer appearance thereof. The battery of the vehicle is charged by fitting and connecting the connector 1 to the feeding-side connector disposed on a feeding facility.

In the following description, an upper side of each figure is referred to as an upper side of the connector 1, a vertical direction of each figure is referred to as a vertical direction, a left side of each section is referred to as a front side of the connector 1, a lateral direction of each section is referred to as a front-rear direction of the connector 1, a left side of FIG. 1 is referred to as a left side of the connector 1 and a lateral direction of FIG. 1 is referred as to as a lateral direction of the connector. The front-rear direction of the connector 1 of this embodiment is aligned with a connecting direction of the feeding side to the connector 1.

As shown in FIG. 1, a substantially hollow forwardly-open cylindrical first receptacle 12A and a substantially hollow forwardly-open cylindrical second receptacle 12B is disposed inside the first receptacle 12A. The second receptacle is one size smaller than the first receptacle 12A, and the receptacles 12A, 12B are provided on a front part of the housing 10. Seven forwardly open substantially tubular terminal accommodating portions are provided independently of each other in three vertically separated stages in the second receptacle 12B.

A middle one of three terminal accommodating portions in the middle stage serves as a first accommodating portion 14 having a male ground terminal (an example of a first terminal) 20 accommodated therein. Second terminal accommodating portions 16 are located at both sides of the first accommodating portion 14 and have male power terminals (an example of a second terminal) 30 respectively accommodated therein. Note that signal terminals 40 are accommodated in two terminal accommodating portions 18 provided in the upper stage.

Figure 2:
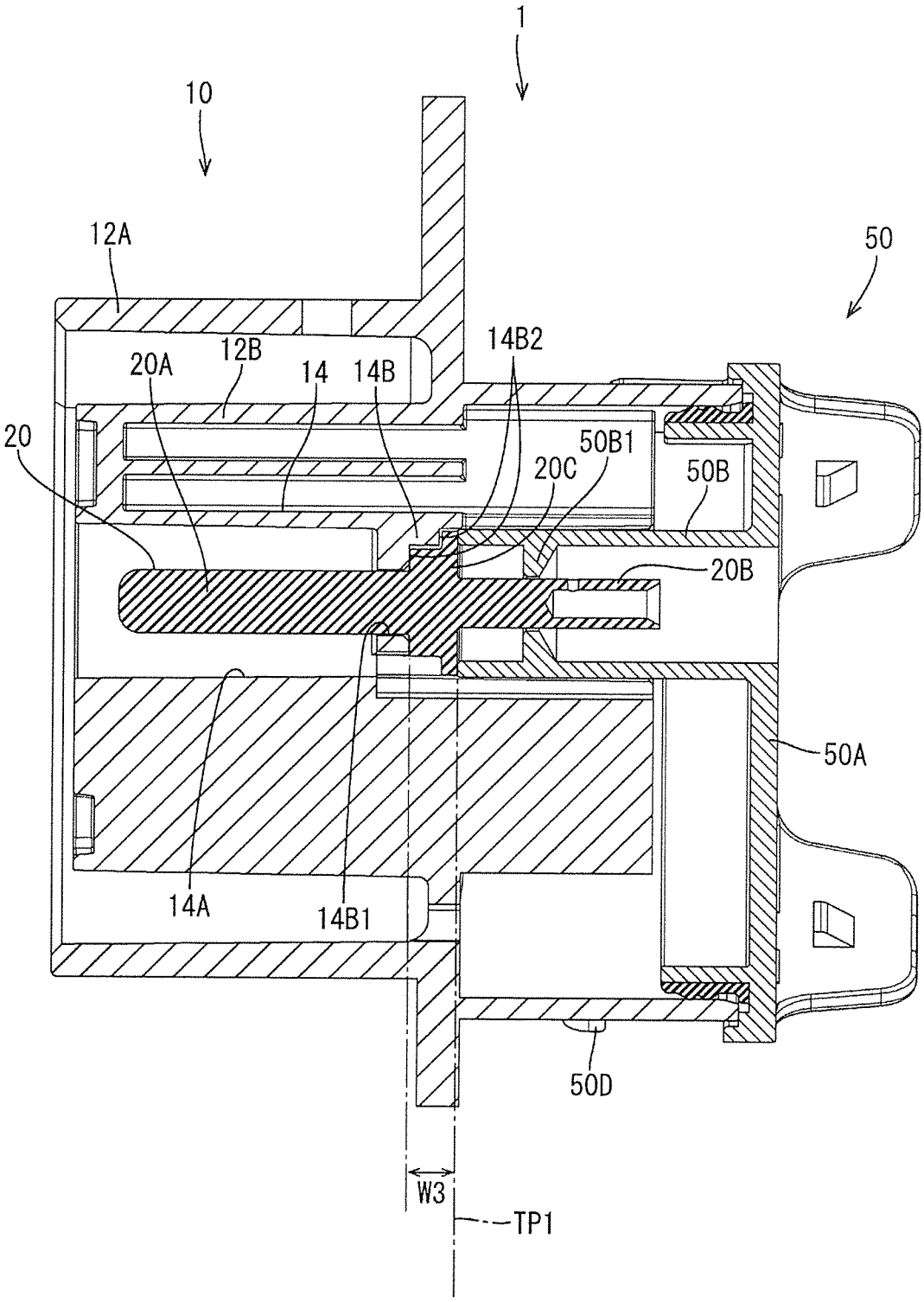
FIG. 2 is a section showing a cross-sectional configuration along II-II in FIG. 1 in a state where a first terminal is accommodated in a first accommodating portion.
Figure 3:
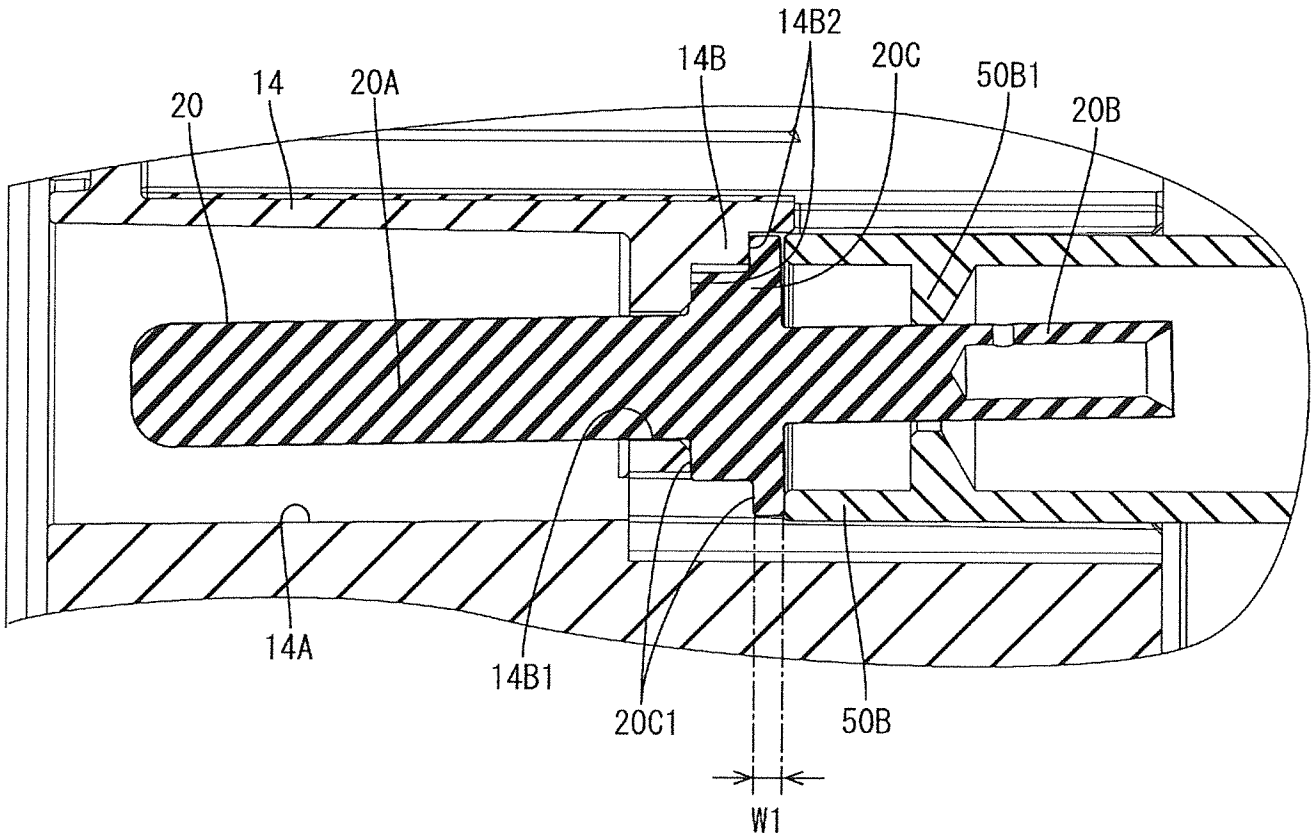
FIG. 3 is an enlarged section enlargedly showing the vicinity of the first terminal in FIG. 2.

As shown in FIG. 2, the first accommodating portion 14 includes a forwardly-open first accommodation space 14A, and a first terminal portion 20A of the ground terminal 20 to be described later is exposed in the first accommodation space 14A. The ground terminal 20 is accommodated into this first accommodating portion 14 from behind. A part of an inner wall of the first accommodating portion 14 protrudes inward while ensuring a through hole 14B1 penetrating in the front-rear direction on a bottom side (rear end side) of the accommodation space 14A, and this protruding part serves as a first locking portion 14B. As shown in FIG. 3, this first locking portion 14B is stepped in the front-rear direction, so that an opening diameter of the through hole 14B becomes larger toward a rear in a stepwise manner.

Figure 4:
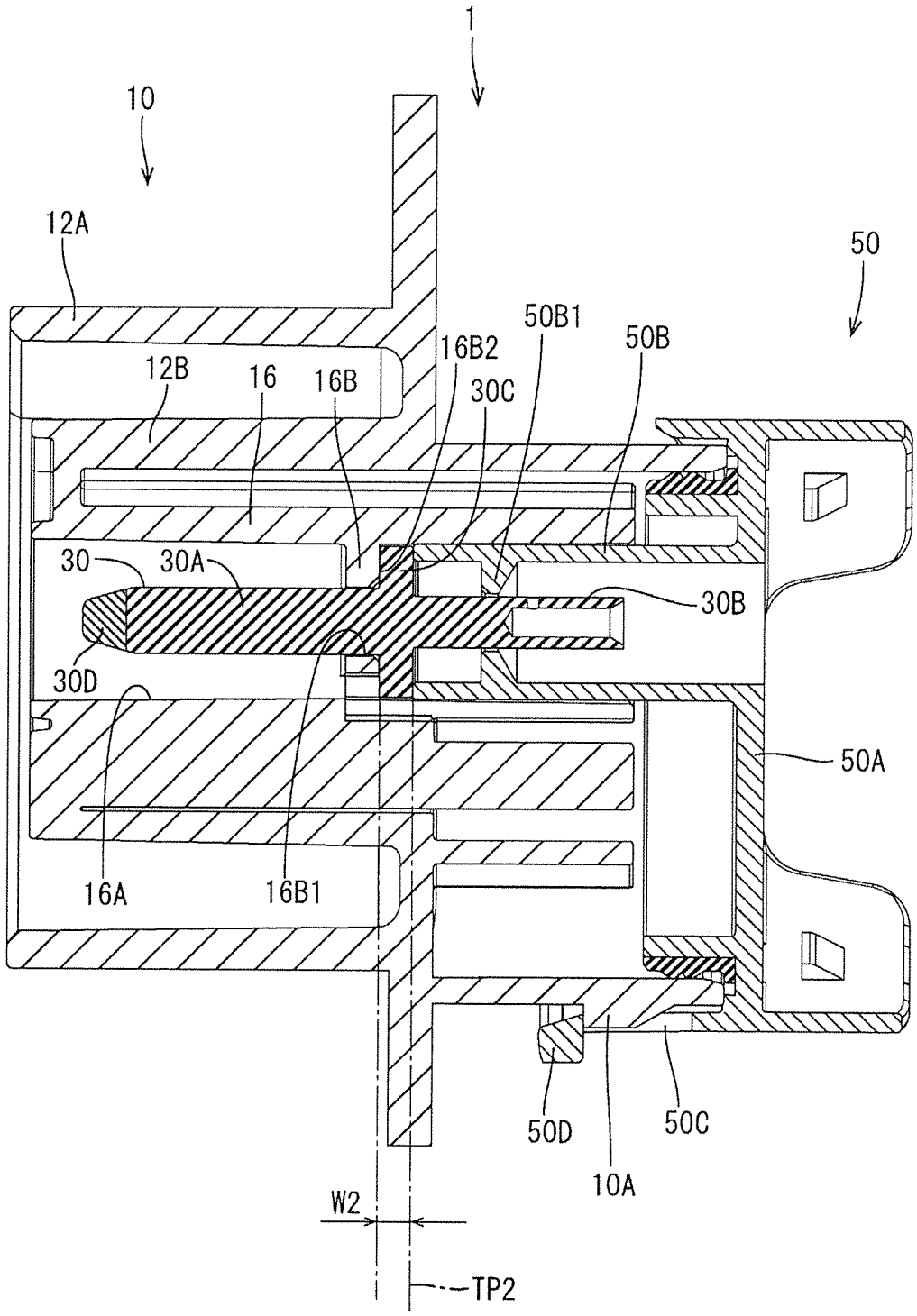
FIG. 4 is a section showing a cross-sectional configuration along IV-IV in FIG. 1 in a state where a second terminal is accommodated in a second accommodating portion.

As shown in FIG. 4, the second accommodating portion 16 includes a forwardly-open second accommodation space 16A, and a second terminal portion 30A of the power terminal 30 to be described later is exposed in the second accommodation space 16A. Each power terminal 30 is accommodated into this second accommodating portion 16 from behind. A part of an inner wall of the second accommodating portion 16 protrudes inward while leaving a through hole 16B penetrating in the front-rear direction on a bottom (rear) of the accommodation space 16A, and this protruding part serves as a second locking portion 16B.

The ground terminal 20 is made of metal and, as shown in FIG. 2, extends like a shaft and is accommodated into the first accommodating portion 14 along an axial direction thereof. A front of the ground terminal 20 is in the form of a shaft and serves as the first terminal portion 20A to be connected to the feeding-side connector, and a rear thereof serves as a first connecting portion 20B to be connected to a wire. Further, a first flange 20C protrudes from a rear part of the first terminal portion 20A. The ground terminal 20 is accommodated and mounted in the first accommodating portion 14 while the first locking portion 14B locks the first flange 20C from behind by to prevent the ground terminal 20 from coming out. The configuration and a locking mode of the first flange 20C are described in detail later.

Each power terminal 30 is made of metal and, as shown in FIG. 4, extends like a shaft and is accommodated into the second accommodating portion 16 along an axial direction thereof. A front side of the power terminal 30 is in the form of a shaft and serves as the second terminal portion 30A to be connected to the feeding-side connector, and a rear side thereof serves as a second connecting portion 30B to be connected to a wire. Further, a second flange 30C is provided on a rear end part of the second terminal portion 30A. The power terminal 30 is accommodated and mounted in the second accommodating portion 16 while being retained not to come out forward by having the second flange 30C thereof locked from behind by the second locking portion 16B of the second accommodating portion 16. The configuration and a locking mode of the second flange 30C are described in detail later.

Further, a safety cap 30D made of insulating synthetic resin is mounted on a tip part of the second terminal portion 30A in the power terminal 30, and prevents a user from mistakenly directly touching the metal of the power terminal 30. Note that the ground terminal 20 and the power terminal 30 have a substantially similar configuration except that the shapes of the first and second flanges 20C, 30C are different, and dimensions thereof in the front-rear direction, diameters of the terminal portions thereof and the like are equal to each other.

A retainer 50 for covering a rear side of the housing 10 is attached to the rear side of the housing 10, as shown in FIG. 2. The retainer 50 is assembled with the housing 10 from behind the housing 10, and includes a base plate 50A and surrounding walls 50B projecting forward from the base plate 50A. The surrounding walls 50B form a substantially tubular shape open in the front-rear direction to circumferentially surround the first connecting portion 20B of the ground terminal 20 accommodated in the first accommodating portion 14 and the second connecting portions 30B of the respective power terminals 30 accommodated in the second accommodating portions 16.

As shown in FIG. 2, tip parts of the surrounding walls 50B of the retainer 50 are in contact with a rear end part of the first flange 20C of the ground terminal 20 accommodated in the first accommodating portion 14 and rear end parts of the second flanges 30C of the respective power terminals 30 accommodated in the second accommodating portions 16. Thus, the ground terminal 20 and the respective power terminals 30 are retained not to come out rearward. Further, projecting portions 50B1 project inward from inner surfaces of the of the surrounding walls 50B and have projecting tips to be located respectively proximate to the first connecting portion 20B of the ground terminal 20 and the second connecting portions 30B of the respective power terminals 20 (see FIG. 3). Note that "proximate" mentioned here also includes a state where the projecting tips of the projecting portions 50B1 are in contact with the first and second connecting portions 20B, 30B.

Further, as shown in FIG. 4, a resilient deforming portion 50C extends forward on a lower part of the retainer 50, and a lock 50D is on a front end part of this resilient deforming portion 50C. On the other hand, a lock receiving portion 10A is provided on a lower end part of the housing 10 and has an inclined surface inclined down from a rear side toward a front side and to be locked by the lock 50D. The retainer 50 is assembled with the housing 10 while moving forward from behind the housing 10. Thus, the resilient deforming portion 50C rides on the lock receiving portion 10A while being resiliently deformed, the resilient deforming portion 50C moves over the lock receiving portion 10A to resiliently return and the lock 50D is locked to the lock receiving portion 10A from the front. As a result, the retainer 50 is fit to the housing 10.

Next, the configuration and locking mode of the first flange 20C and the configuration and locking mode of the second flange 30C are described. As shown in FIGS. 2 and 3, the first flange 20C is stepped in the front-rear direction by being composed of a plurality of disc-shaped parts whose outer diameters become larger toward the rear in a stepwise manner. On the other hand, the first locking portion 14B of the first accommodating portion 14 is stepped in the front-rear direction as described above, thereby including a plurality of contact surfaces 14B2 (see FIG. 3) to be held in contact with the first flange 20C in the front-rear direction with the ground terminal 20 accommodated in the first accommodating portion 14.

As shown in FIG. 3, the first locking portion 14B has a stepped shape in conformity with the stepped shape of the first flange 20C. Thus, with the ground terminal 20 accommodated in the first accommodating portion 14, the disc-shaped parts of the first flange 20C are respectively in contact with the contact surfaces 14B2 of the first locking portion 14B in the front-rear direction, as shown in FIGS. 2 and 3. Note that reference sign 20C1 shown in FIG. 3 denotes each contact surface of the first flange 20C in contact with each contact surface 14B2 of the first locking portion 14B. The position of a rear end of the first flange 20C with the ground terminal 20 accommodated in the first accommodating portion 14 is referred to as a proper position TP1 (see FIG. 2) of the ground terminal 20 accommodated in the first accommodating portion 14.

As shown in FIG. 4, the second flange 30C is a single disc, and a thickness W2 thereof in the front-rear direction is larger than a thickness W1 (see FIG. 3) in the front-rear direction of the disc-shaped part located on a rearmost side of the first flange 20C. On the other hand, the second locking portion 16B of the second accommodating portion 16 has one contact surface 16B2 to be held in contact with the front surface of the flange 20C in the front-rear direction with the power terminal 30 accommodated in the second accommodating portion 16 (see FIG. 4). The position of a rear end part of the second flange 30C with the power terminal 30 accommodated in the second accommodating portion 16 is referred to as a proper position TP2 (see FIG. 4) of the power terminal 30 accommodated in the second accommodating portion 16.

When the ground terminal 20 is accommodated into the first accommodating portion 14 to be mounted into the housing 10, the ground terminal 20 is at the proper position TP1 thereof. When the power terminal 30 is accommodated into each second accommodating portion 16 to be mounted into the housing 10, the power terminal 30 is at the proper position TP2 thereof. Thereafter, the retainer 50 is moved forward from behind the housing 10 to bring the front parts of the surrounding walls 50B into contact with the rear end part of the first flange 20C and the rear end parts of the second flanges 30C so that the retainer 50 is fit to the housing 10.

Figure 5:
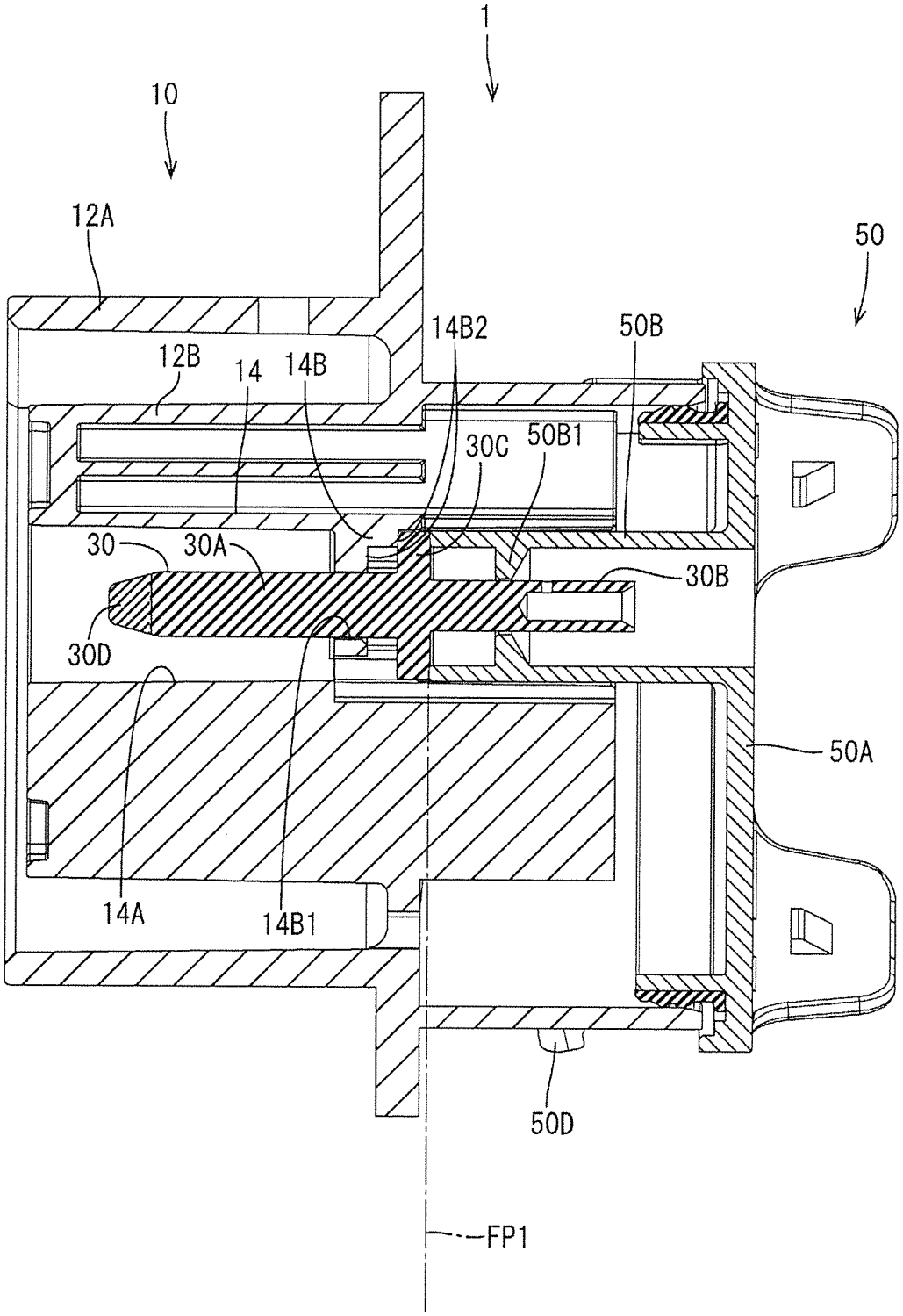
FIG. 5 is a section showing a cross-sectional configuration corresponding to the section of FIG. 2 in a state where the second terminal is erroneously mounted in the first accommodating portion.
Figure 6:
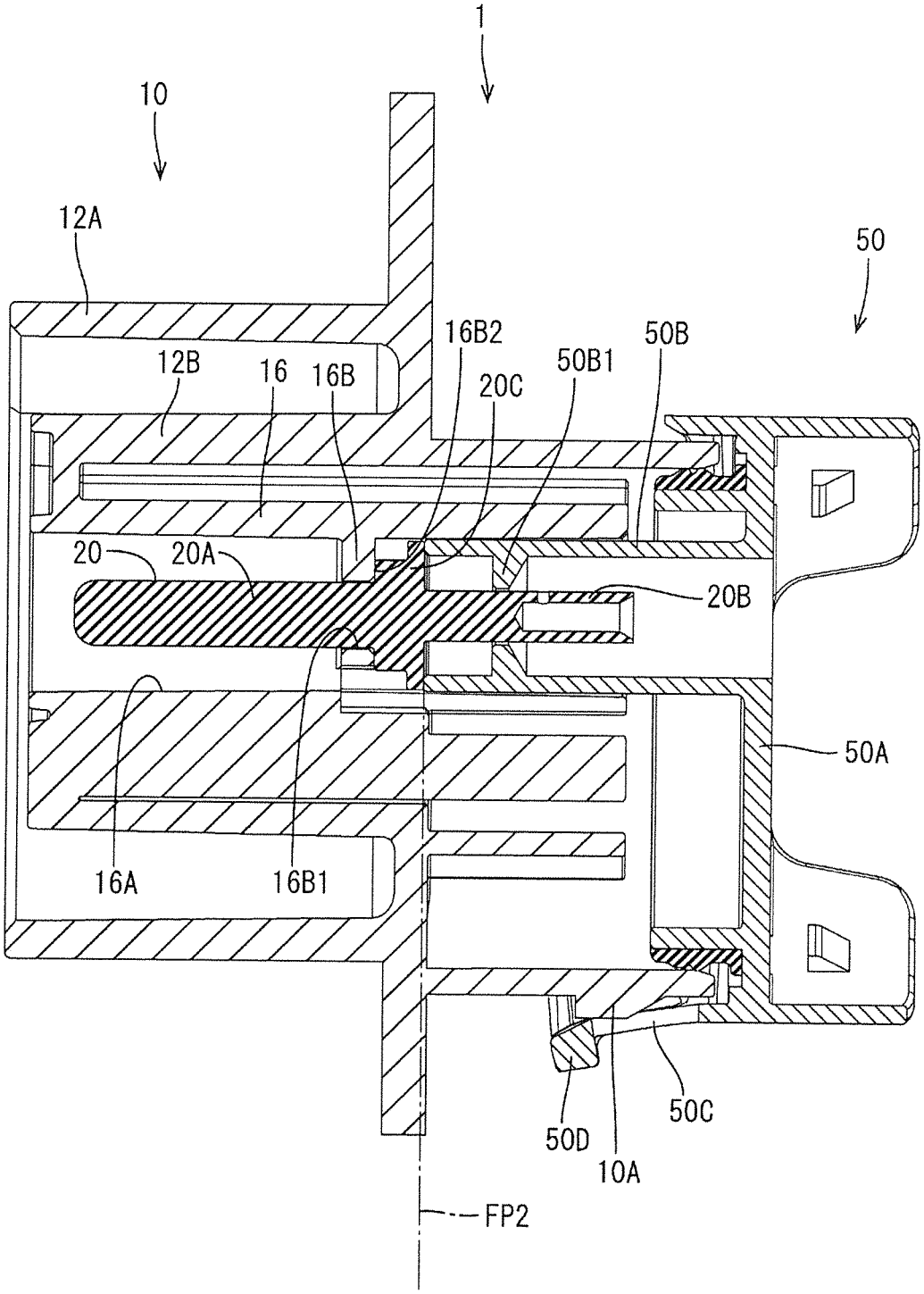
FIG. 6 is a section showing a cross-sectional configuration corresponding to the section of FIG. 4 in a state where the first terminal is erroneously mounted in the second accommodating portion.

Assume that the power terminal 30 erroneously is mounted into the housing 10. Specifically, assume that the power terminal 30 is accommodated into the first accommodating portion 14 from behind, as shown in FIG. 5, and the ground terminal 20 is accommodated into the second accommodating portion 16 from behind, as shown in FIG. 6. Then, as shown in FIG. 5, the second flange 30C of the power terminal 30 comes into contact with only the contact surface 14B2 located on the rearmost side of the first locking portion 14B. In this state, since the thickness W2 of the second flange 30C is larger than the thickness W1 of the disc-shaped part located on the rearmost side of the first flange 20C, the position of the rear end part of the second flange 30C is shifted rearward of the proper position TP1 of the terminal accommodated in the first accommodating portion 14, i.e. a position where the first flange 20C of the ground terminal 20 is locked by the first locking portion 14B. Note that an improper position shifted rearward of the proper position TP1 is denoted by reference sign FP1 in FIG. 5.

If the retainer 50 is moved forward and assembled with the housing 10 from behind the housing 10 in a state where both the ground terminal 20 and the power terminal 30 are shifted rearwardly of the proper positions in this way, the front end parts of the respective surrounding walls 50B of the retainer 50 contact the rear part of the first flange 20C of the ground terminal 20 and the rear parts of the second flanges 30C of the respective power terminals 30 with the resilient deforming portion 50C of the retainer 50 riding on the lock receiving portion 10A, as shown in FIG. 6. Thus, the retainer 50 cannot be moved any farther forward and the lock 50D of the retainer 50 cannot be locked to the lock receiving portion 10A of the housing 10. Thus, the retainer 50 cannot be fit to the housing 10 at a proper position.

Further, as shown in FIG. 6, the contact surface 20C1 of the disc-shaped part located on a foremost side of the first flange 20C of the ground terminal 20 contacts the contact surface 16B2 of the second locking portion 16B. In this state, since an entire thickness W3 of the plurality of disc-shaped parts of the first flange 20C is larger than the thickness W2 of the second flange 30C, the position of the rear end part of the first flange 20C is shifted rearward of the proper position TP2 of the power terminal 30 accommodated in the second accommodating portion 16, i.e. a position where the second flange 30C of the power terminal 30 is locked by the second locking portion 16B. Note that an improper position shifted rearwardly of the proper position TP2 is denoted by reference sign FP2 in FIG. 6.

If the retainer 50 is moved forward and assembled with the housing 10 from behind the housing 10 with the ground terminal 20 shifted rearward of the proper position TP1 in this way, the front end part of the surrounding wall 50B comes into contact with the rear end part of the first flange 20C of the ground terminal 20 with the resilient deforming portion 50C of the retainer 50 riding on the lock receiving portion 10A of the housing 10, as shown in FIG. 6. Thus, the retainer 50 cannot be moved any farther forward, and the lock 50D of the retainer 50 cannot be locked to the lock receiving portion 10A of the housing 10. Thus, the retainer 10 cannot be fit to the housing 10 at the proper position.

As described above, the ground terminal 20 can be accommodated in the first accommodating portion 14 by having the first flange 20C locked by the first locking portion 14B of the first accommodating portion 14, and the power terminal 30 can be accommodated in the second accommodating portion 16 by having the second flange 30C locked by the second locking portion 16B of the second accommodating portion 16. The ground terminal 20 and the power terminal 30 have substantially similar configurations except for the flanges 20C, 30C thereof. Hence, even if both terminals 20, 30 are mounted erroneously, it is difficult to discriminate erroneous mounting from the outside of the connector 1.

In this respect, if the power terminal 30 erroneously is accommodated into the first accommodating portion 14, the power terminal 30 is positioned at the improper position FP1 shifted rearward of the proper position TP1 of the ground terminal 20 accommodated in the first accommodating portion 14. Thus, even if it is attempted to assemble the retainer 50 with the housing 10 from behind the housing 10 thereafter, the retainer 50 cannot be fit to the housing 10. Therefore, it easily can be discriminated from the outside of the connector 1 that the power terminal 30 erroneously has been accommodated into the first accommodating portion 14 and the erroneous mounting of the terminals can be corrected.

Further, if the ground terminal 20 erroneously is accommodated into the second accommodating portion 16, the ground terminal 20 is positioned at the improper position FP2 shifted rearward of the proper position TP2 of the power terminal 30 accommodated in the second accommodating portion 16. Thus, even if it is attempted to assemble the retainer 50 with the housing 10 from behind the housing 10 thereafter, the retainer 50 cannot be fit to the housing 10. Therefore, it easily can be discriminated from the outside of the connector 1 that the ground terminal 20 erroneously has been accommodated into the second accommodating portion 16 and the erroneous mounting of the terminals can be corrected.

Further, the surrounding walls 50B of the retainer 50 are provided with the projections 50B to be respectively located proximate to the first connecting portion 20B of the ground terminal 20 accommodated in the first accommodating portion 14 and the second connecting portions 30B of the power terminals 30 accommodated in the respective accommodating portions 16. Thus, if the front end of one of the ground terminal 20 and the power terminals 30 accommodated in the first accommodating portion 14 and the second accommodating portions 16 is being displaced downward, the connecting portion of the one terminal interferes with the projection 50B1. Thus, the inclination of the respective terminals 20, 30 can be suppressed when the ground terminal 20 and the power terminals 30 are accommodated respectively in the first accommodating portion 14 and the second accommodating portions 16, and dimensional accuracy in the mounted state of the respective terminals 20, 30 accommodated in the respective accommodating portions 14, 16 can be enhanced.

The invention is not limited to the above described and illustrated embodiment. For example, the following embodiments also are included in the scope of the invention.

Although the ground terminal 20 is illustrated as an example of the first terminal and the power terminal 30 is illustrated as an example of the second terminal in the above embodiment, a power terminal may be an example of the first terminal and a ground terminal may be an example of the second terminal. Further, the first and second terminals may be terminals other than the ground terminal and the power terminal.

The shapes of the first and second flanges can be changed.

Although the connector provided in the vehicle to be fit and connected to the feeding-side connector is illustrated as an example of the connector in the above embodiment, the connector disclosed in this specification may be a connector used in another application.

Although the embodiments have been described in detail above, these are merely illustrative and do not limit the scope of claims. A technique described in claims includes various modifications and changes of the specific example illustrated above.

LIST OF REFERENCE SIGNS

1 . . . connector
10 . . . housing
14 . . . first accommodating portion
14B . . . first locking portion
16 . . . second accommodating portion
16B . . . second locking portion
20 . . . ground terminal (first terminal)
20A . . . first terminal portion
20B . . . first connecting portion
20C . . . first flange portion
30 . . . power terminal (second terminal)
30A . . . second terminal portion
30B . . . second connecting portion
30C . . . second flange portion
50 . . . retainer
TP1 . . . proper position (of terminal accommodated in first accommodating portion)
TP2 . . . proper position (of terminal accommodated in second accommodating portion)
FP1 . . . improper position (of terminal accommodated in first accommodating portion)
FP2 . . . improper position (of terminal accommodated in second accommodating portion)

The invention claimed is:

1. A connector, comprising:

a first terminal including a shaft-like first terminal portion and a first flange protruding from the first terminal portion;

a second terminal including a shaft-like second terminal portion and a second flange protruding from the second terminal portion;

a housing open forward and including a first accommodating portion into which the first terminal is accommodated from behind and retained so as not to come out forward and a second accommodating portion into which the second terminal is accommodated from behind and retained so as not to come out forward; and a retainer to be assembled with the housing from behind the housing;

wherein:

the first terminal is positioned at a proper position in a front-rear direction with respect to the housing by being accommodated into the first accommodating portion along an axial direction of the first terminal portion and having the first flange locked by a first locking portion provided on an inner wall of the first accommodating portion; and the second terminal is positioned at a proper position in the front-rear direction with respect to the housing by being accommodated into the second accommodating portion along an axial direction of the second terminal portion and having the second flange locked by a second locking portion provided on an inner wall of the second accommodating portion and the second terminal is positioned rearward of the proper position in the front-rear direction if the second terminal is accommodated into the first accommodating portion and the second flange is locked by the first locking portion;

the first flange has disc-shaped parts with outer diameters that become larger toward a rear end to define steps in the front-rear direction;

the first locking portion is shaped so that a part of the inner wall of the accommodating portion protrudes inward while defining a through hole penetrating in the front-rear direction and having a protruding part that is stepped in the front-rear direction so that an opening diameter of the through hole becomes larger toward the rear in a stepwise manner, and having contact surfaces to be held in contact with the first flange in the front-rear direction when the first terminal is in the first accommodating portion; and the second flange is a single disc that has a thickness in the front-rear direction larger than a thickness in the front-rear direction of the disc-shaped part of the first flange that is located on a rearmost position on the first flange, and the second flange is in contact with only the contact surface located at a rearmost position on the first locking portion if the second terminal is in the first accommodating portion.

2. A connector, comprising:

a first terminal including a shaft-like first terminal portion and a first flange protruding from the first terminal portion;

a second terminal including a shaft-like second terminal portion and a second flange from the second terminal portion;

a housing open forward and including a first accommodating portion into which the first terminal is accommodated from behind and retained so as not to come out forward and a second accommodating portion into which the second terminal is accommodated from behind and retained so as not to come out forward; and a retainer to be assembled with the housing from behind the housing;

wherein:

the first terminal is positioned at a proper position in a front-rear direction with respect to the housing by being accommodated in the first accommodating portion along an axial direction of the first terminal portion and having the first flange locked by a first locking portion provided on an inner wall of the first accommodating portion;

the second terminal is positioned at a proper position in the front-rear direction with respect to the housing by being accommodated in the second accommodating portion along an axial direction of the second terminal portion and having the second flange locked by a second locking portion provided on an inner wall of the second accommodating portion, whereas the second terminal is rearward of the proper position in the front-rear direction if the second terminal is in the first accommodating portion and the second flange is locked by the first locking portion; and the first terminal is rearward of the proper position in the front-rear direction if the first terminal is accommodated into the second accommodating portion and the first flange is locked by the second locking portion.

3. A connector comprising:

a first terminal including a shaft-like first terminal portion and a first flange protruding from the first terminal portion;

a second terminal including a shaft-like second terminal portion and a second flange protruding from the second terminal portion;

a housing open forward and including a first accommodating portion into which the first terminal is accommodated from behind and retained so as not to come out forward and a second accommodating portion into which the second terminal is accommodated from behind and retained so as not to come out forward; and a retainer to be assembled with the housing from behind the housing;

wherein:

the first terminal is at a proper position in a front-rear direction with respect to the housing by being in the first accommodating portion along an axial direction of the first terminal portion and having the first flange locked by a first locking portion on an inner wall of the first accommodating portion;

the second terminal is at a proper position in the front-rear direction with respect to the housing by being in the second accommodating portion along an axial direction of the second terminal portion and having the second flange locked by a second locking portion on an inner wall of the second accommodating portion, whereas the second terminal is rearward of the proper position in the front-rear direction if the second terminal is in the first accommodating portion and the second flange is locked by the first locking portion;

the second flange is a single disc;

the second locking portion has one contact surface to be held in contact with the second flange in the front-rear direction when the second terminal is accommodated in the second accommodating portion by a part of the inner wall of the second accommodating portion protruding inward while defining a through hole penetrating in the front-rear direction; and the first flange has a plurality of disc-shaped parts with outer diameters that become larger toward a rear end to define steps in the front-rear direction, a thickness of the plurality of disc-shaped parts in the front-rear direction is larger than a thickness of the second flange in the front-rear direction, and only the disc-shaped part located on a foremost side of the first flange is in contact with the contact surface of the second locking portion when the first terminal is in the second accommodating portion.

4. A connector comprising:

a first terminal including a shaft-like first terminal portion and a first flange protruding from the first terminal portion;

a second terminal including a shaft-like second terminal portion and a second flange protruding from the second terminal portion;

a housing open forward and including a first accommodating portion into which the first terminal is accommodated from behind and retained so as not to come out forward and a second accommodating portion into which the second terminal is accommodated from behind and retained so as not to come out forward; and a retainer to be assembled with the housing from behind the housing;

wherein:

the first terminal is at a proper position in a front-rear direction with respect to the housing by being accommodated into the first accommodating portion along an axial direction of the first terminal portion and having the first flange locked by a first locking portion provided on an inner wall of the first accommodating portion;

the second terminal is at a proper position in the front-rear direction with respect to the housing by being accommodated into the second accommodating portion along an axial direction of the second terminal portion and having the second flange locked by a second locking portion provided on an inner wall of the second accommodating portion, whereas the second terminal is rearward of the proper position in the front-rear direction if the second terminal is in the first accommodating portion and the second flange is locked by the first locking portion;

the retainer is fittable to the housing by being moved forward from behind the housing to a position where a front end part thereof comes into contact with each of a rear end part of the first terminal and a rear end part of the second terminal when the first and second terminals are at the proper positions;

the first terminal includes a shaft-like first connecting portion disposed behind the first flange;

the second terminal includes a shaft-like second connecting portion disposed behind the second flange;

the retainer includes a surrounding wall circumferentially surrounding at least one of the first connecting portion of the first terminal and the second connecting portion of the second terminal when the retainer is fit to the housing; and a projection projecting inward from an inner surface of the surrounding wall and having a projecting tip to be located proximate to at least one of the first connecting portion and the second connecting portion.

* * * * *